United States Patent [19]

Lumen

[11] 4,289,211

[45] Sep. 15, 1981

[54] ROCK DRILL BIT

[75] Inventor: Karl L. G. Lumén, Sandviken, Sweden

[73] Assignee: Sandvik Aktiebolag, Sandviken, Sweden

[21] Appl. No.: 83,664

[22] Filed: Oct. 11, 1979

Related U.S. Application Data

[63] Continuation-in-part of Ser. No. 880,993, Feb. 24, 1978, Pat. No. 4,181,187.

[30] Foreign Application Priority Data

Mar. 3, 1977 [SE] Sweden ..... 7702345
May 28, 1979 [AT] Austria ..... 3859/79

[51] Int. Cl.[3] ..... E21C 13/00; E21C 13/08
[52] U.S. Cl. ..... 175/410; 299/91
[58] Field of Search ..... 175/410, 374, 409, 412, 175/413; 403/41; 299/91

[56] References Cited

U.S. PATENT DOCUMENTS

| | | | |
|---|---|---|---|
| 2,022,194 | 11/1935 | Galvin | 175/410 |
| 2,030,576 | 2/1936 | Erickson | 175/410 |
| 3,100,545 | 8/1963 | Zimmerman | 175/410 |
| 3,618,683 | 11/1971 | Hughes | 175/410 |
| 3,807,804 | 4/1974 | Kniff | 175/410 |
| 3,970,002 | 5/1978 | Kidder et al. | 175/410 |
| 3,970,158 | 7/1976 | Black et al. | 175/410 |

*Primary Examiner*—James A. Leppink
*Attorney, Agent, or Firm*—Burns, Doane, Swecker & Mathis

[57] ABSTRACT

A rock drill bit comprises a steel body including a front peripheral surface having a plurality of holes. Each hole includes a steel cylindrical wall portion, a steel bottom wall portion, and a radially enlarged steel transition wall portion extending between a longitudinally inner end of the cylindrical wall portion and a radially outward end of the bottom wall portion. A plurality of hard metal inserts are mounted in the holes. Each insert includes: a cylindrical surface portion directly abutting against the cylindrical wall portion of said hole and extending longitudinally inwardly at least as far as the longitudinally inner end of the cylindrical wall portion of the hole. The transition wall portion of the hole extends from the longitudinally inner end of said cylindrical wall portion of said hole so as to contain no abrupt concave corners which cause localized stress concentrations in the wall of the hole and subsequent fatigue failure therein. The ratio of the radial distance from the cylindrical surface of the insert to the radially outermost part of the transition wall, to the diameter of the cylindrical surface of the insert is in the range of from 1:25 to 1:75.

4 Claims, 7 Drawing Figures

Fig.4
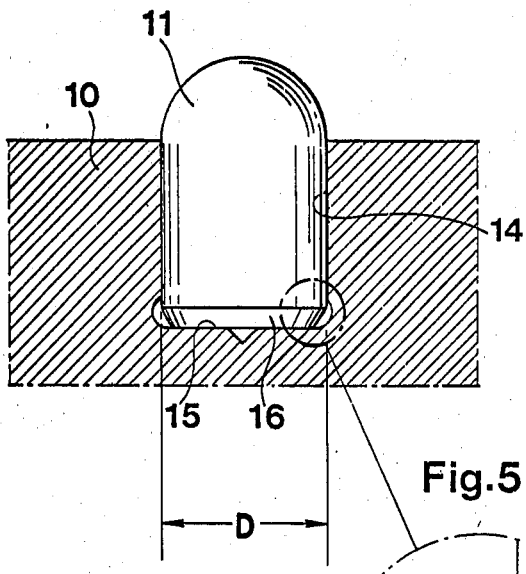
Fig.5
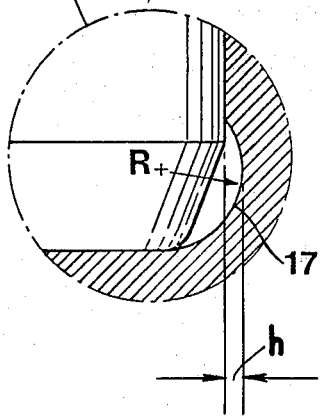
Fig.6
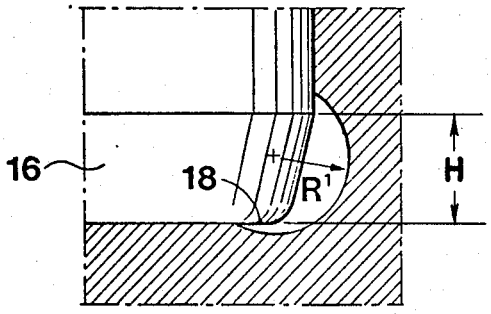
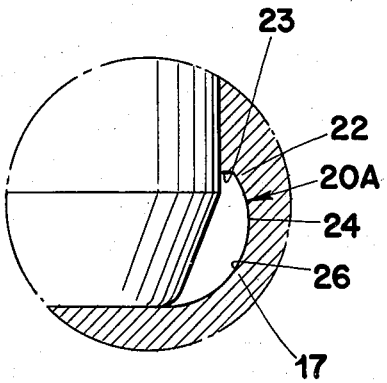
Fig. 7

ROCK DRILL BIT

RELATED INVENTIONS

This is a continuation-in-part of U.S. application Ser. No. 880,993 filed Feb. 24, 1978, now U.S. Pat. No. 4,181,187.

BACKGROUND AND OBJECTS OF THE INVENTION

The present invention relates to a rock drill bit consisting of a metallic body portion of steel having a peripheral front surface equipped with cylindrical hard metal inserts that protrude from interferringly sized holes in said body portion.

Rock drill bits equipped with button-shaped inserts are nowadays used to increased extent instead of drill bits with chisel-shaped inserts. This development has occurred for several reasons. In the first hand use of button inserts leads to an increased number of contact points between the bit and the bottom of the hole to be drilled which results in a more calm and undisturbed performance of the drill bit at work. At the same time this leads to less strains exerted to the drill equipment. Further, more fine-grained drill cuttings easy to flush away will be produced as a result of using button bits.

When proceeding with further development of drill bits with button inserts it has been observed that insert attachment procedure is primarily responsible for the level to which improvements in the bit life can be reached. Press or interference fit has been found to be the necessary type of insert attachment for reaching as safe attachment as possible between the hard metal inserts and the steel body portion. When the steel bit body proceeds through the hole to be drilled each button insert is subjected to a reaction force from the rock which presses the insert towards the bottom of its hole. The insert is then relieved and an elastic return movement of the insert occurs. For each load cycle a relative movement between insert and bit body thus occurs. This causes deformation to the wall material of the insert-receiving hole exerted by the insert's hard metal, the hardness of which is substantially greater than the hardness of the steel bit body. Due to the tensile forces occurring as a result of the insert's movement which are of fatigue character steel cracks of gradually increasing size develop in said wall material which causes rupture of the steel supporting material such that the inserts come loose and makes the drill bit unusable.

The present invention proposes a new technical solution of insert attachment to its steel body such that development of cracks in the supporting steel material has been prevented and appreciable improvements in the bit life have been reached.

SUMMARY OF THE INVENTION

To this end, the wall portions of the insert-receiving holes in the steel body portion are provided with laterally recessed portions between the cylindrical wall and the bottom of the hold such that the cylindrical mantle surface of each insert, located nearest the bottom of the hole, is freely exposed.

The wall of the hole extends from the longitudinally inner end of the cylindrical wall portion of the hole in a direction having at least a radially outward component, then extends in a direction having longitudinally inward and radially outward components, thereafter extends in a direction having longitudinally inward and radially inward componets and finally adjoins the bottom wall portion of the hole, so as to contain no abrupt concave corners which cause localized stress concentrations in the wall of the hole and subsequent fatique failure therein. The ratio of: the radial distance from the cylindrical surface of said insert to the radially outermost part of said transition wall, to the diameter of said cylindrical surface of said insert, is in the range of from 1:25 to 1:75.

THE DRAWING

The invention will now be explained more in detail with reference to the appended drawings, which illustrate a percussion drill bit according to one embodiment of the invention, in which:

FIG. 4 is a sectional view similar to FIG. 2 but illustrating the manner of providing attachment between insert and steel body according to the present invention;

FIG. 5 is an enlarged view taken on FIG. 4;

FIG. 6 is an enlarged view similar to FIG. 5 but illustrating an alternative manner of providing attachment between insert and steel body portion according to the present invention; and FIG. 7 is a view similar to FIG. 5 of another embodiment of the invention.

DETAILED DESCRIPTION OF A PREFERRED EMBODIMENT OF THE INVENTION

Figure 1:
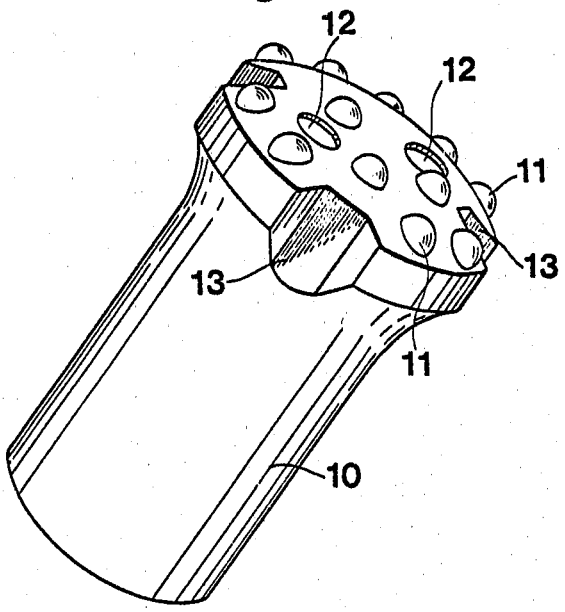
FIG. 1 is a percussion drill bit of conventional design.

Referring now to FIG. 1, a percussion drill bit body 10 of steel is shown, the front surface of which is provided with precision-bored holes for receiving cylindrical button inserts 11 of hard metal, usually cemented carbide, thereinto. Each insert 11 has a smoothly rounded protruding end portion. The bit body is additionally provided with flushing channels 12 adjoining the bit's front surface and peripherally provided recesses 13 to facilitate flushing away drill cuttings from the bottom of the hole to be drilled.

Figure 2:
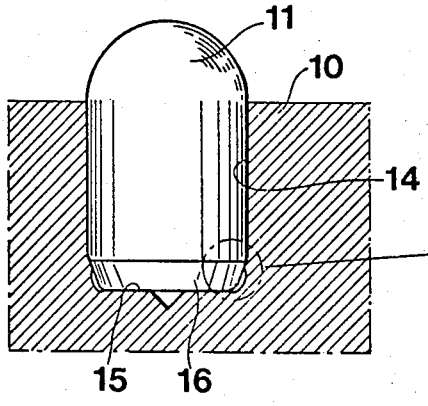
FIG. 2 is a sectional view illustrating a hard metal insert secured to the steel body by interference fit in a conventional manner.
Figure 3:
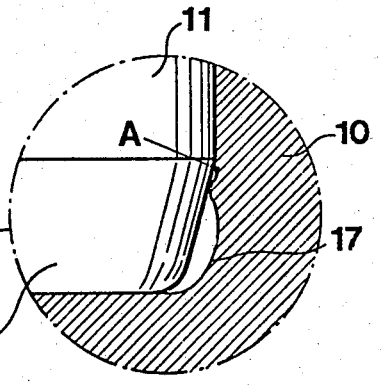
FIG. 3 is an enlarged view taken on FIG. 2.

Conventionally, each insert 11 is secured to the steel body 10 by being pressed into interferringly sized cylindrical holes 14 such that the insert abuts against the bottom 15 of said hole. The lowermost end portion 16 of the insert received in said hole 15 is usually slightly chamfered off conically as shown in FIG. 2. The amount of interference fit between insert and bit body must be of such great amount that the insert is kept in place during drilling. In spite of the large amount of interference fit used, a relative movement always occurs between insert 11 and bit body 10 for each loading cycle as a consequence of the loading force from the rock which initially presses the insert towards the hole bottom 15 whereupon the insert is relieved and an elastic return movement of the insert occurs. This causes deformation to the wall material of the insert-receiving hole 14 due to the differences in hardness between hard metal and steel. This results in a fractural impression at point A in FIG. 3 and development of tensile forces of fatigue character on that point. Rupture of the nearest steel supporting material such that the insert comes loose will be the result thereof.

According to the present invention the transition region 17 between the hole bottom 15 and the hole wall 14 is provided as a laterally recessed portion the extension of which is such that the lowermost cylindrical mantle surface portion of the insert, located nearest the bottom of the hole 14, is freely exposed relative to the surrounding wall portion. The conically chamfered off bottom portion 16 of the insert thus is entirely located within that laterally recessed area 17 as well as a minor cylindrical mantle surface portion of the insert located thereabove.

A key dimension of the recess 17 is the radial distance h from the cylindrical surface of the insert to the radially outermost part of the recess 17. The ratio of that distance h to the diameter D of the insert 11 should lie within the range of from 1:25 to 1:75 and preferably is about 1:35.

This laterally recessed portion 17 is suitably produced by turning and provided as a rounded recess of a certain radius R. It is to be understood, however, that also other configurations of said recess might alternatively be used which contain no abrupt concave corners which cause localized stress concentrations in the wall of the hole and subsequent fatigue failure therein.

If a radiused recess 17 is employed, the radius R should be less than the height H of the chamfered portion 16. Preferably, the radius R is less than the longitudinal height H, but greater than one-half the height H, i.e., $H/2<R<H$.

Thanks to the above-related configuration of the bottom region of the insert-receiving hole it has been found possible to prevent development of steel cracks of fatigue character such as described before.

Referring now to FIG. 6 there is shown a slightly modified embodiment of the invention, wherein the bottom region of the insert-receiving hole is laterally recessed with a radius of curvature of such an amount R' that a portion of the insert's bottom surface 18, located near the transition region between hole bottom and the lowermost wall portion of said hole 14, is exposed within said lateral recess 17. Such a configuration of the recess makes it possible to eliminate the chamfered portion 16 of the insert. Rather, the outer surface of the insert can be entirely cylindrical. In such a case, the insert 11 is inserted into the hole 14 after the hole has been enlarged by heating of the bit body 10. Upon cooling, the hole contracts and grips the insert 11.

In the embodiments of FIGS. 5 and 6 the transition wall 20 of the recess 17 extends from the longitudinally inner end 22 of the cylindrical wall portion of the hole 14 in a direction having both radial and longitudinal components. As is evident from FIG. 7, it is also possible for the transition wall 20A to extend from the longitudinally inner end 22 in a radial direction 23. It is imperative, however, that such portion of the transition wall have at least a radial component and not extend purely longitudinally.

After extending radially, the wall 20A then extends in a direction 24 having longitudinally inwardly and radially outward components, and thereafter in a direction 26 having longitudinally inward and radially inward components.

Having described the preferred embodiment of the drill it must be understood that this invention is not to be limited to the precise details shown. It is possible, for instance, to give the insert-receiving hole bottom another configuration than plane as shown in the appended drawings. The principles of the invention may also apply as well to insert-receiving holes provided in earth boring rotatable cutters.

What is claimed is:

1. A rock drill bit comprising:

a steel body including a front peripheral surface, said surface having a plurality of holes extending longitudinally inwardly from said surface, said holes each including:

a steel cylindrical wall portion, a steel bottom wall portion defining the longitudinally inner end of said hole, and a radially enlarged steel transition wall portion extending between a longitudinally inner end of said cylindrical wall portion and a radially outward end of said bottom wall portion, a plurality of hard metal inserts mounted in said holes and projecting outwardly of said surface, said inserts each including a side surface comprising:

a cylindrical surface portion directly abutting against said cylindrical wall portion of said hole, said cylindrical surface portion extending longitudinally inwardly at least as far as said longitudinally inner end of said cylindrical wall portion of said hole, and a radially disposed bottom surface portion defining a longitudinally inner end of said insert, said transition wall portion of said hole extending from said longitudinally inner end of said cylindrical wall portion of said hole in a direction having at least a radially outward component, then extending in a direction having longitudinally inward and radially outward components, thereafter extending in a direction having longitudinally inward and radially inward components and finally adjoining said bottom wall portion, so as to contain no abrupt concave corners which cause localized stress concentrations in the wall of the hole and subsequent fatique failure therein;

the ratio of:

the radial distance from the cylindrical surface of said insert to the radially outermost part of said transition wall, to the diameter of said cylindrical surface of said insert, being in the range of from 1:25 to 1:75.

2. Apparatus according to claim 1, wherein said ratio is preferably 1:35.

3. Apparatus according to claim 1, wherein said transition wall portion extends from said longitudinally inner end of said cylindrical wall portion of said hole in a direction having radially outward and longitudinally inward components.

4. Apparatus according to claim 1, wherein said side surface of said insert further includes a tapered surface portion extending longitudinally and radially inwardly from said longitudinally inner end of said cylindrical surface portion, said transition wall portion includes a section generated by a radius which is shorter than the longitudinal height of said tapered surface portion and longer than one-half such height.

* * * * *